United States Patent [19]

Hoelzl

[11] Patent Number: 4,754,989

[45] Date of Patent: Jul. 5, 1988

[54] SKI, IN PARTICULAR A CROSS-COUNTRY SKI

[75] Inventor: Klaus Hoelzl, Vienna, Austria

[73] Assignee: TMC Corporation, Baar, Switzerland

[21] Appl. No.: 13,206

[22] Filed: Feb. 6, 1987

Related U.S. Application Data

[63] Continuation of Ser. No. 700,259, Feb. 11, 1985.

[30] Foreign Application Priority Data

Feb. 10, 1984 [AT] Austria ..... 424/84
May 18, 1984 [AT] Austria ..... 1656/84

[51] Int. Cl.[4] ..... A63C 5/07
[52] U.S. Cl. ..... 280/602; 280/615
[58] Field of Search ..... 280/602, 604, 605, 609, 280/615; 52/729

[56] References Cited

U.S. PATENT DOCUMENTS

| | | | |
|---|---|---|---|
| 2,258,046 | 10/1941 | Clement | 280/602 |
| 3,398,968 | 8/1968 | Mutzhas | 280/602 |
| 3,849,963 | 11/1974 | Harmon | 52/729 |
| 4,300,786 | 11/1981 | Alley | 280/602 |

FOREIGN PATENT DOCUMENTS

| | | | |
|---|---|---|---|
| 247763 | 10/1965 | Austria | 280/602 |
| 281644 | 9/1969 | Austria . | |
| 735464 | 4/1943 | Fed. Rep. of Germany | 280/604 |
| 1428941 | 4/1969 | Fed. Rep. of Germany | 280/602 |
| 140422 | 3/1980 | Fed. Rep. of Germany | 280/604 |
| 1109560 | 1/1956 | France . | |
| 1467141 | 1/1967 | France . | |

*Primary Examiner*—John J. Love
*Assistant Examiner*—Eric Culbreth
*Attorney, Agent, or Firm*—Flynn, Thiel, Boutell & Tanis

[57] ABSTRACT

A cross country ski has a bending resistance which is changeable with the help of at least one bending beam, the beam extending longitudinally of the ski and being arranged in the center of the ski. The bending beam is arranged loosely inside of the ski, symmetrically in relationship to a vertical longitudinal center plane of the ski, and is supported at its two ends on support surfaces of the body of the ski which extend approximately parallel to the running surface. In a first preferred embodiment, pressure can be applied to the beam on a side thereof which does not face the support surfaces by a pressure element which is supported on the body of the ski in the region of the upper side thereof. In a second preferred embodiment, the beam has on its side which does not face the support surfaces a pressure-transmitting member, to which a pressure toward the beam can be applied by a control mechanism.

29 Claims, 8 Drawing Sheets

SKI, IN PARTICULAR A CROSS-COUNTRY SKI

This application is a continuation of application Ser. No. 700,259, filed Feb. 11, 1985.

FIELD OF THE INVENTION

This invention relates to a ski and, in particular, to a cross-country ski having a bending resistance which can be changed with the help of at least one bending beam which extends longitudinally of the ski and is arranged in the center region of the ski.

BACKGROUND OF THE INVENTION

Such a ski is described in U.S. Patent No. 4,300,786. This ski has at the two narrow side surfaces grooves which are rectangular in cross section and into which rods are inserted, which rods can be considered pressure bars in a broad sense. Depending on the desired stiffness of the ski, the skier can select the correct rods from a series of rods. Each rod resists bending with two different resistances, depending on whether it is inserted into the groove in its initial position or in a position rotated 90° from the initial position. To secure the rods, which are usually held by friction, it is possible to utilize screws or bolts.

The handling and use of the known ski is extremely complicated, since the skier must at all times carry a large number of rods. Furthermore, it is often difficult for the skier to select the particular rods which are the most suitable for the existing snow conditions.

The invention has as a purpose to overcome the disadvantages of this known design and to provide a ski in which an exchange of pressure bars is not needed.

SUMMARY OF THE INVENTION

Starting out from a ski of the above-mentioned type, two inventive constructions are provided for the attainment of this purpose. A first preferred embodiment is distinguished by a bending beam, arranged loosely inside of the ski and symtetrically with respect to a vertical longitudinal center plane of the ski, being supported at its two ends on support surfaces in the body of the ski, which support surfaces extend approximately parallel to the running surface. Pressure can be applied to the beam on a side which does not face the support surfaces by a pressure element which is supported on the body of the ski in the region of the upper side of the ski. This design permits in a simple manner an adjustment of the ski to the weight of the user and existing snow conditions.

In the second preferred embodiment, the bending beam is arranged loosely inside of the ski and symmetrically with respect to a vertical longitudinal center plane of the ski, and is supported at its two ends on support surfaces in the body of the ski, which support surfaces extend approximately parallel to the running surface. The beam has on a side which does not face the support surfaces a pressure-transmitting member, onto which can be applied a pressure directed toward the bending beam by a control mechanism which can be operated by the shoe of the skier. In this construction, the bending resistance is changed in synchronism with the rhythm of the stepping movement of the cross-country skier and, through this, cross-country skiing is made substantially easier.

BRIEF DESCRIPTION OF THE DRAWINGS

Several exemplary embodiments of a ski embodying the invention are disclosed in the drawings, in which.

DETAILED DESCRIPTION

Figure 1:
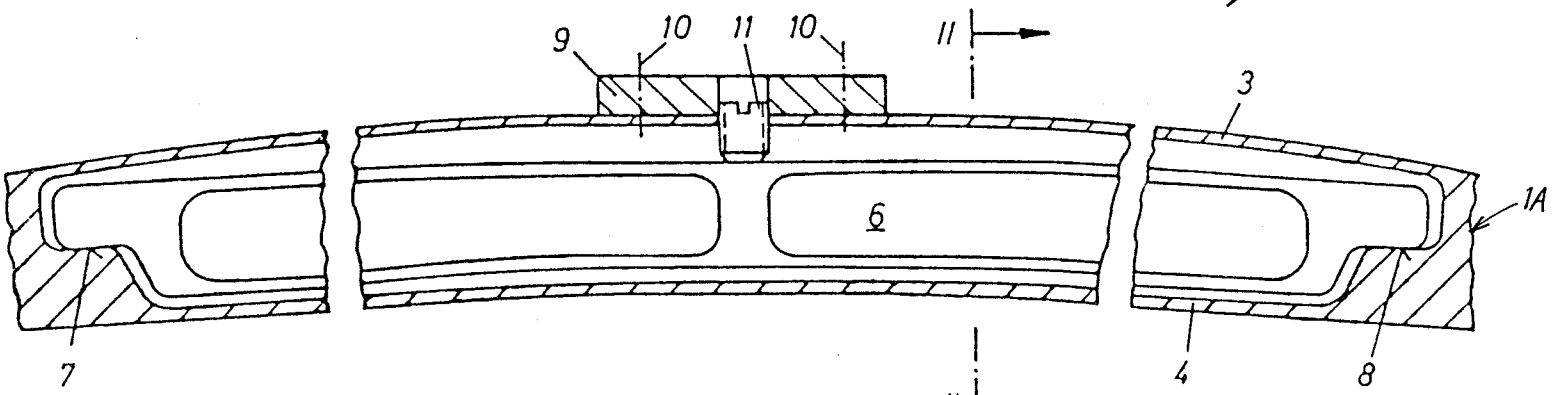
FIG. 1 is a fragmentary sectional side view taken along the line I—I in FIG. 2 of a ski embodying the invention.
Figure 2:
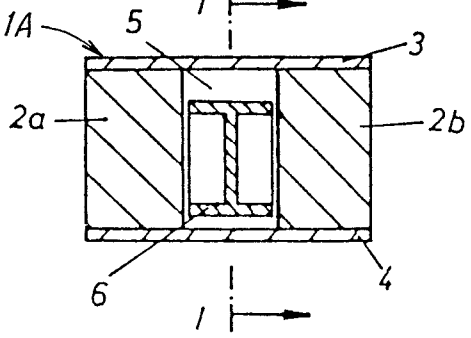
FIG. 2 is a sectional view taken along the line II—II in FIG. 1.

A ski is identified in its entirety with reference numeral 1 in FIGS. 1 and 2. It includes a body runner 1A with a core having two sections *2a* and *2b* (FIG. 2), an upper belt 3, and a lower belt 4. The core has in its center, in the so called "wax region", a slot or cavity 5 which extends symmetrically with respect to a vertical longitudinal center plane of the ski and divides the core into the two sections *2a* and *2b*. A bending beam 6 is provided in the slot 5 and has a width of approximately one third of the width of the ski. The beam 6 has a substantially I-shaped cross section in FIG. 2, extends approximately over the center third or "wax region" of the ski, and is reinforced in the region of its two ends and at its center, as shown in FIG. 1. The beam 6 rests at its two ends on support surfaces 7 and 8 of the ski. These support surfaces 7 and 8 are provided on resisting reinforcing blocks which are glued to the two belts 3 and 4 and in this manner effectively form with the belts an integral unit.

A plate 9 is secured, for example by means of screws 10, to the upper belt 3 in the center of the upper side of the ski. The plate 9 has a vertical taphole in its center, into which is screwed a setscrew 11. By adjusting the setscrew 11, the user of the ski can change its bending resistance.

In particular, if the user desires a "soft" ski 1, then the screw 11 is screwed upwardly. In this condition, the beam 6 has no influence on bending of the ski, since it can move freely in the slot 5 toward the upper belt 3, namely, the ski 1 is not stiffened. Alternatively, if the user of the ski 1 wants to use a "stiff" ski, then the screw 11 is screwed downwardly, so that the beam 6 presses with an initial tension of the two support surfaces 7 and 8. The beam 6 and ski 1 then effectively form one unit which is substantially more difficult to bend than is the case in the first discussed condition. Of course, various intermediate positions of the setscrew 11 are also possible and permit an exact adjustment of the ski to particular snow conditions, namely, from wet snow to dry snow.

Figure 3:
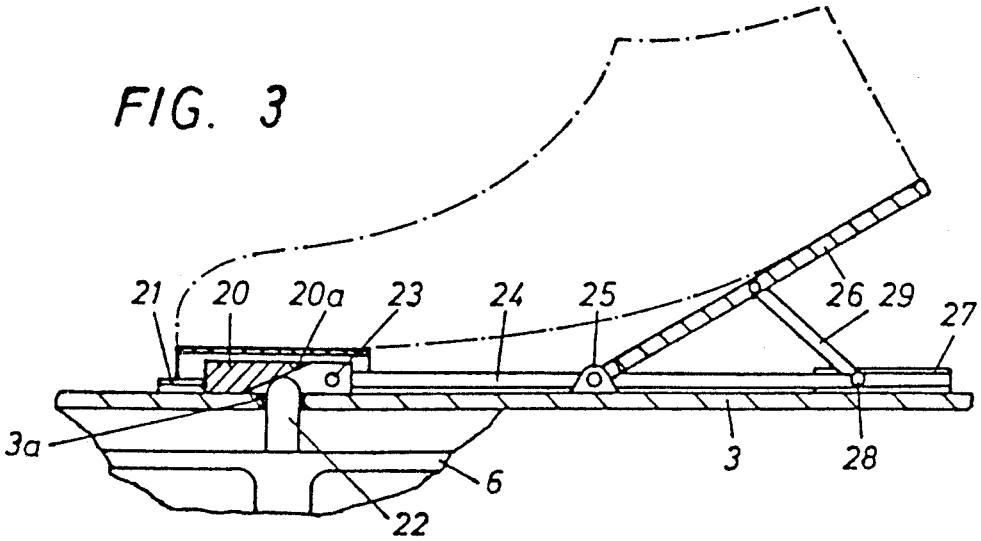
FIGS. 3 to 5 are each a fragmentary sectional side view of a respective one of three further embodiments which each permit a cyclic operational change of the bending resistance of the ski.

In the embodiment according to FIG. 3, a bolt or pin 22 is secured on the top of the beam 6 in a cross-country ski, which bolt 22 is movable vertically in a bore 3*a* in the upper, belt 3. In the region above the bolt 22, two guide rails 21 are secured on the upper belt 3, between which guide rails 21 there is movably guided a slide member 20. The slide member 20 has an inclined surface 20*a* and carries at its end which faces the ski shoe an axle 23 on which two pull rods 24 are pivotally supported. Furthermore, a bearing block 25 for a sole plate 26 and two further, guide rails 27 are secured on the upper belt 3 at locations spaced from the slide member 20, in which guide rails 27 are movably guided the ends of a hinge axle 28 which connects the two pull rods 24. The pivotally supported sole plate 26 is, in its center, connected by two hinge plates 29 to the hinge axle 28. The sole plate 26 does not support the entire sole of the cross-country ski shoe, but only the portion which lies between the ball of the foot and the heel.

In this embodiment, when the sole plate 26 is moved down by the heel of the user (sliding phase), then the slide member 20 is moved to the right in FIG. 3 by the hinge plates 29 and the two pull rods 24. The bolt 22 is, through this, pressed downwardly into the bore 3*a* by the inclined surface 20*a* of the slide member 20, and thus a stiffening of the ski is achieved by means of the beam 6, which in this manner is tensioned. This stiffening is maintained only as long as the entire sole of the ski shoe rests on the upper belt 3. When the heel of the skier is moved up (push-off phase) and the sole plate 26 swings counterclockwise, the slide member 20 is moved to the left in FIG. 3 and the tension of the beam 6 is cancelled. The ski is therefore "soft" in this phase of operation.

Figure 4:
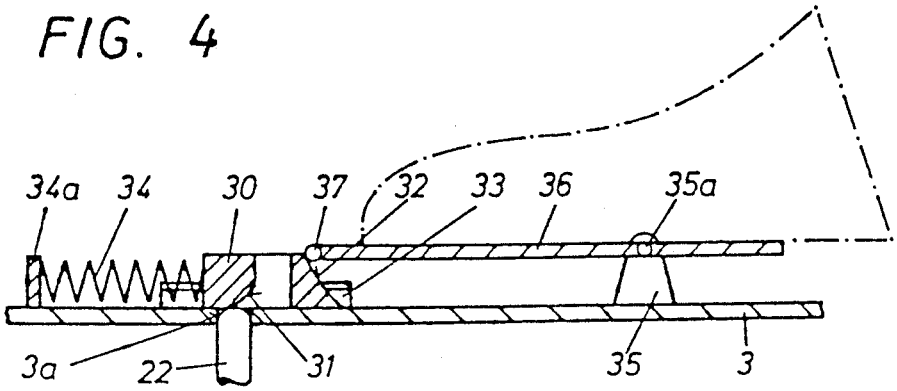

A modified embodiment of the cross-country ski of FIG. 3, in which the bending resistance can be changed cyclically, is illustrated in FIG. 4. This embodiment has a slide member 30 which, in contrast to the slide member 20 of FIG. 3, has two control surfaces 31 and 32. The surface 31 is used to control the bolt 22 on the bending beam and the surface 32 is used to move the slide member 30 in a direction toward the tip of the ski. The slide member 30 is again guided in two lateral guide rails 33, and is under the influence of a compression spring 34 which urges it toward the tail of the ski and which is supported on a ski-fixed bearing block 34*a*. Spaced from the slide member 30 is a further bearing block 35, on which a sole plate 36, which is a two-arm lever, is supported pivotally by an axle 35*a*. The sole plate 36 carries at its end which faces the slide member 30 a roller 37, which can roll along the control surface 32.

In the position which is illustrated in FIG. 4, the sole of the ski shoe is parallel to the upper belt 3 (gliding phase). The bending beam, which is not illustrated, therefore reinforces the stiffness of the ski. When the toe of the ski shoe is pressed downwardly (push-off phase) and the sole plate 36 is pivoted counterclockwise about the axle 35*a*, the slide member 30 is moved toward the tip of the ski against the urging of the spring 34 by the roller 37 rolling toward the upper belt 3 on the control surface 32. Through this movement of the slide member 30, the bolt 22 slides upwardly on the control surface 31, which in turn reduces the tension of the beam and thus the stiffness of the ski. Through this, a bending of the cross-country ski in the "wax region" is made easier in the push-off phase.

When, during the course of cross-country skiing, the ski is relieved of the weight of the skier or is lifted off the ground, the sole plate 36 is swung back in a clockwise direction into the initial position which is illustrated in FIG. 4. The slide member 30 is thus moved to the right by the spring 34 and the bolt 22 is again pressed down. Through this, the ski is stiffened by the tensioned beam for the subsequent stepping phase (sliding), with the weight load in the heel area.

Figure 5:
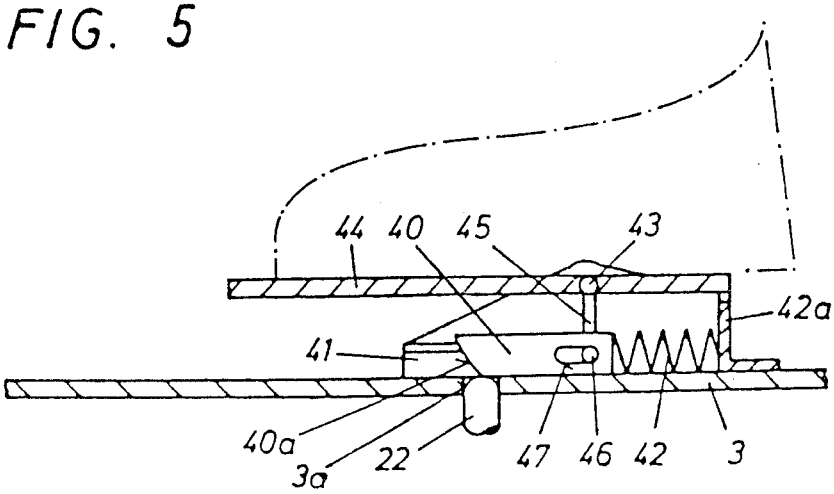

In the embodiment according to FIG. 5, a slide member 40 is provided, which is guided in guide rails 41 for movement parallel to the upper belt 3, which carries a cam 40*a* at its front end and which is biased by a pressure spring 42. The pressure spring urges the slide member 40 toward the tip of the ski and is supported on a bearing block 42*a* which is secured, for example by screws, on the upper belt 3. The bearing block 42*a* is, viewed in the top view, U-shaped and carries in the center of its legs a transverse axle 43, on which is pivotally supported a sole plate 44. The sole plate 44 has two downwardly projecting arms 45 which carry a bolt 46 which extends through a preferably arcuate slot 47 in the slide member 40, which slot 47 extends approximately longitudinally of the ski.

FIG. 5 shows the position of the cross-country ski in which the beam is in a tensioned position (sliding phase). If the skier shifts his weight from the heel to the toe of the ski shoe (push-off phase), then the sole plate 44 is pivoted counterclockwise about the transverse axle 43. Through this, the arms 45 are swung rearwardly and the bolt 46 is moved toward the tail end of the ski against the force of the pressure spring 42. This results in a movement of the slide member 40 toward the tail end of the ski. The bolt 22 thereby slides upwardly along the cam 40*a* and the beam tension is released, so that in this phase a bending of the ski in the "wax region" is made easier.

When, during the course of cross-country skiing, the ski is relieved of the weight of the skier or is lifted off the ground, the sole plate 44 is swung back clockwise into the initial position which is illustrated in FIG. 5. The slide member 40 is moved by the spring 42 to the left, and the bolt 22 is again pressed down. Through this, the ski is stiffened by the transverse beam for the following stepping phase (sliding), with the weight load in the heel area.

Figure 7:
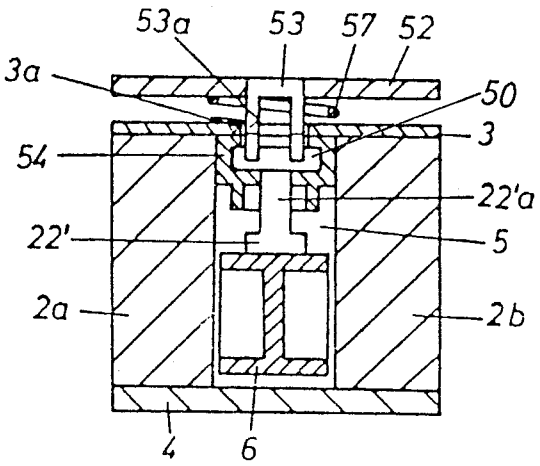
FIG. 7 is a sectional view taken along the line VII—VII in FIG. 6.
Figure 6:
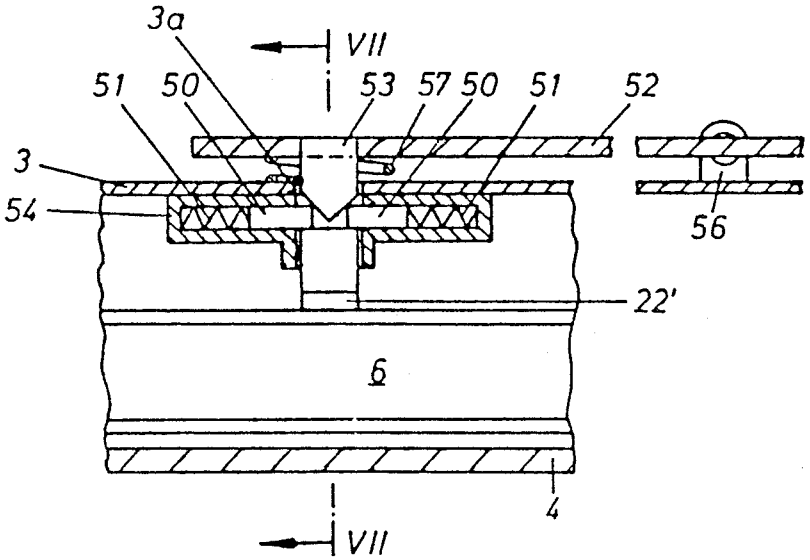
FIG. 6 is a fragmentary longitudinal sectional side view of a further alternative embodiment.

A slightly modified embodiment is illustrated in FIGS. 6 and 7. In this embodiment, a bolt 22' is secured on the beam 6 and is guided for up and down movement in a bore 3*a* of the upper belt 3. The bolt 22' is engaged by two slide members 50 which are movable against the force of compression springs in directions parallel to the upper side of the ski, and in FIG. 6 the members 50 are holding the bolt 22' in a position in which the beam 6 is tensioned. The two slide members 50 and the springs 51 are arranged in a housing 54, which is supported on the underside of the upper belt 3.

Furthermore, a bearing block 56 is arranged on the upper belt 3 and pivotally supports a pedal 52 by means of an axle which extends transversely to the longitudinal direction of the ski. The pedal 52 extends forwardly to the region of the bolt 22' and carries in this region a pressure piece 53 which is encircled by a pressure spring 57. The lower end of the pressure spring 57 is supported on the upper belt 3.

The downwardly pointing end of the pressure piece 53 is, viewed in a side view (FIG. 6), V-shaped and its two inclined surfaces engage the slide members 50. The bolt 22' carries at its upper end a rib 22'*a* which is rectangular in cross section. A groove or slot 53*a* is provided in the pressure piece 53, is rectangular in cross section, and can receive the rib 22'*a*. Of course, the rib 22'*a* and the groove 53*a* extend in the direction of movement of the two slide members 50.

In the tensioned position of the beam 6 (sliding phase), the pedal 52 assumes the position which is illustrated in FIG. 6. When the front of the pedal 52 is thereafter pressed downwardly against the force of the pressure spring 57, the two slide members 50 are moved outwardly against the urging of the springs 51, so that the bolt 22' can move upwardly in the bore 3*a*. The rib 22'*a* of the bolt 22' thereby moves upwardly into the groove 53*a* in the pressure piece 53, which is moving in a direction opposite to the direction of movement of the bolt 22'. Through this, bending of the ski is made easier in the wax region during the sliding phase.

When the weight of the skier is shifted from the front of the ski shoe to the heel area thereof, the pedal 52 is returned by the spring 57 to the position illustrated in FIG. 6. If the ski is not bent, the bolt 22' will move downwardly in the bore 3*a*. This makes it possible for the two slide members 50 to be moved by the force of the springs 57 toward the axis of the bolt 22' and to lock the bolt 22' in the tensioning position shown in FIG. 6. In contrast to the prior exemplary embodiments, only a fully tensioned and fully nontensioned condition of the ski are possible in this embodiment; intermediate tensions are not possible.

Figure 8:
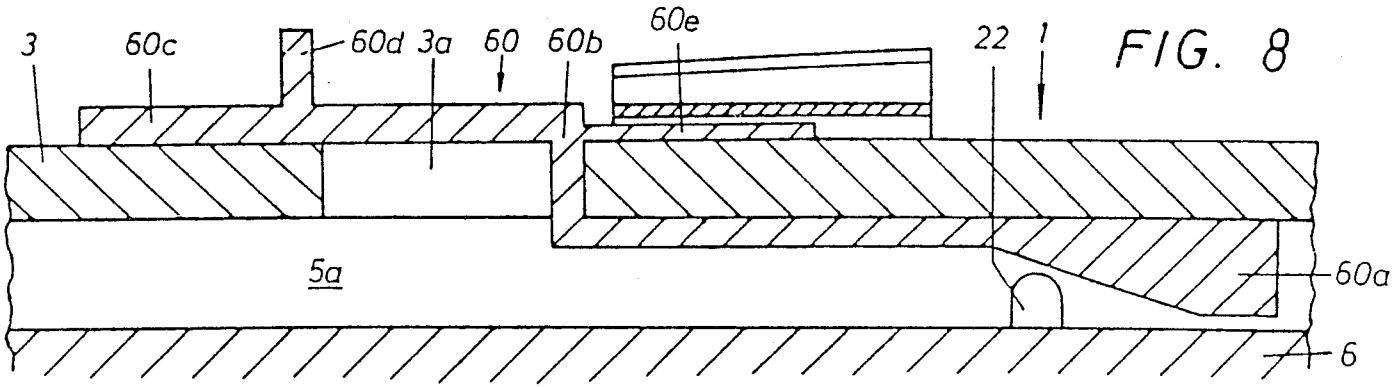
FIG. 8 is a fragmentary longitudinal sectional side view of a further alternative embodiment.
Figure 9:
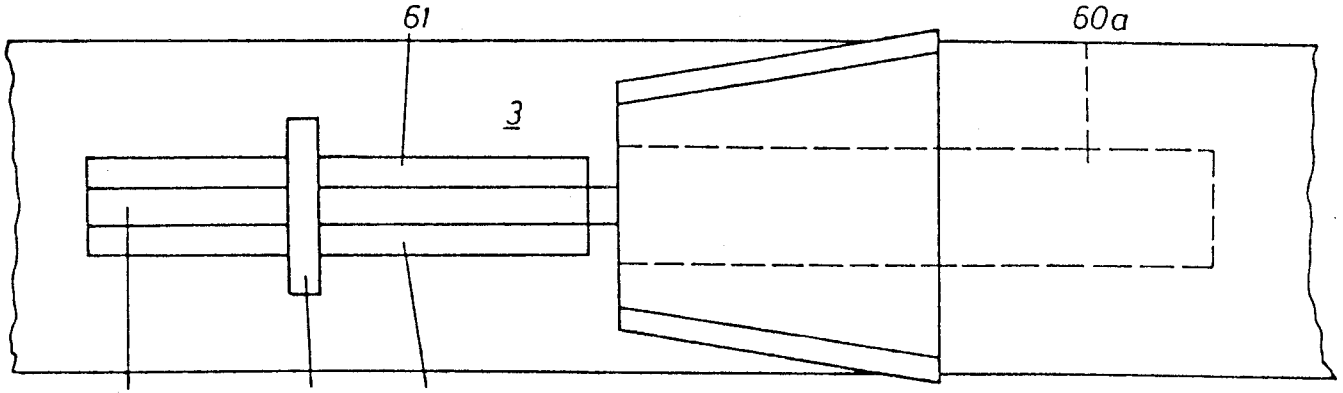
FIG. 9 is a fragmentary top view of the embodiment of FIG. 8.

In a further embodiment shown in FIGS. 8 and 9, the upper belt is identified with reference numeral 3 and the beam of the cross-country ski 1 is identified with reference numeral 6. The beam 6 carries a pin 22 which, in connection with a slide member 60 which is described in greater detail later on, serves to change the initial tension of the beam 6. A common, schematically illustrated cross-country ski binding is secured on the upper belt 3. Between the upper belt 3 and the transverse beam 6 there is a free space 5*a* in which the slide member 60 is movably supported. The slide member 60 has a portion 60*a* which carries an inclined surface and extends longitudinally of the ski in the space 5*a*, a crosspart 60*b* which is perpendicular to the portion 60*a* and extends through a longitudinal slot 3*a* in the upper belt 3, a portion 60*c* which is supported on the upper side of the upper belt 3 and has a handle 60*d*, and a cover portion 60*e* which extends from the crosspart 60*b* in a direction away from the portion 60*c*. The portion 60*c* is guided for movement longitudinally of the ski by means of two guiderails 61 secured on the upper side of the upper belt 3.

By adjusting the slide member 60 in the longitudinal direction of the ski, it is possible to change the stiffness or camber of the ski 1 in cooperation with the pin 22. In particular, according to FIG. 8, there is a free space between the pin 22 and the inclined surface of the slide member 60 in a nonstressed condition of the ski 1. This free space is reduced with an increase in the force produced by the skier, until the inclined surface of the slide member 60 engages the pin 22. Up to this point in time, the ski 1 is relatively soft. A further force applied to the ski 1 initially tensions the beam 6 so that it too acts as a carrying element, which results in a stiffening of the ski.

Alternatively, if the inclined surface of the slide member 60 is brought into contact with the pin 22 in the nonloaded condition of the ski 1, then stiffening of the ski 1 commences as soon as any force is applied.

If in the nonloaded condition the slide member 60 is moved still further to the left, then an initial tension of the beam 6 relative to the ski 1 occurs, which causes an increase in the stiffness.

The slot 3*a* in the upper belt 3 is covered by the cover portion 60*e* of the slide member to prevent the penetration of snow into the free space 5*a*.

Figure 10:
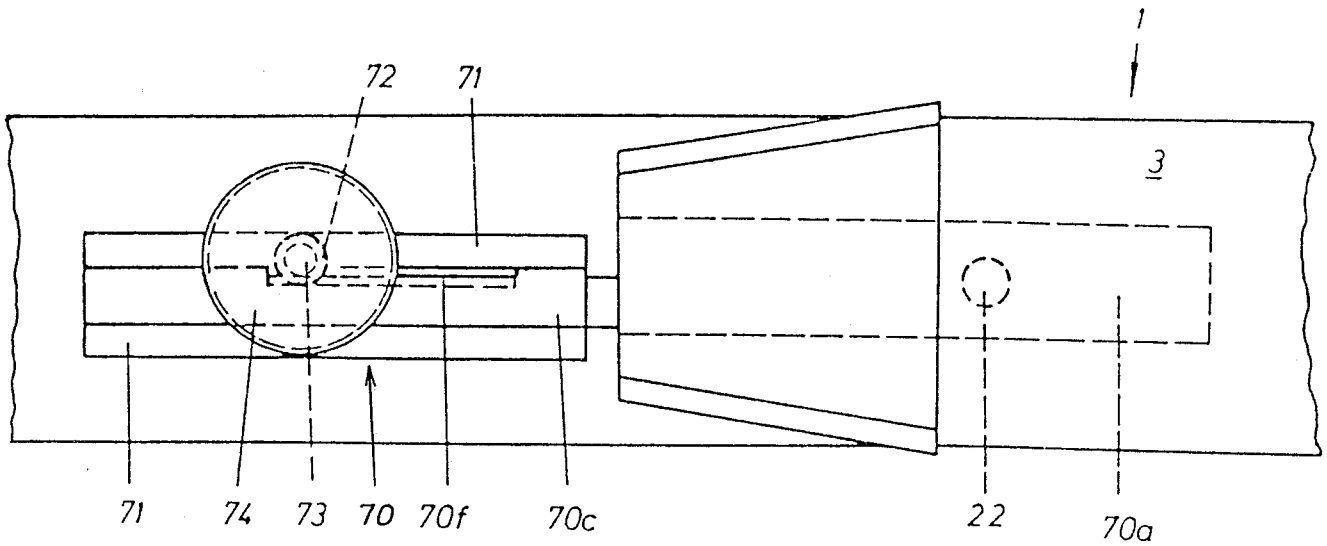
FIG. 10 is a fragmentary top view of another alternative embodiment.

The embodiment according to FIG. 10 is very similar to the embodiment of FIGS. 8 and 9. It differs therefrom only in that the portion 70*c* of a slide member 70 is provided with a rack 70*f* which mates with a pinion 72 secured on a shaft 73. The shaft 73 is arranged perpendicular to the upper side of the ski and is supported rotatably in the body of the ski 1. The upper end of the shaft 73 carries a rotary knob which is knurled on its periphery and can be engaged by the fingers of the user. In this manner, a precise adjusting of the slide member 70 is possible.

Figure 12:
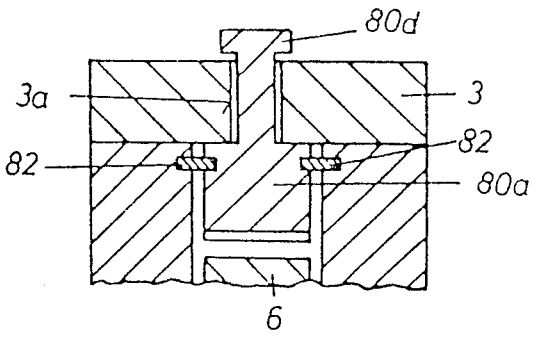
FIG. 12 is a fragmentary sectional view taken along the line XII—XII in FIG. 11.
Figure 11:
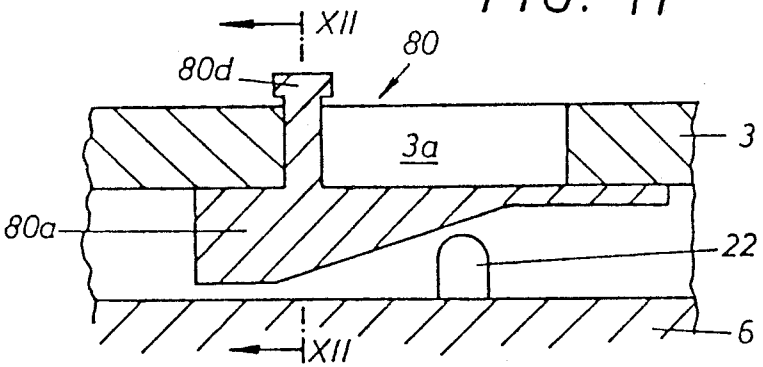
FIG. 11 is a fragmentary longitudinal sectional view of yet another alternative embodiment.
Figure 13:
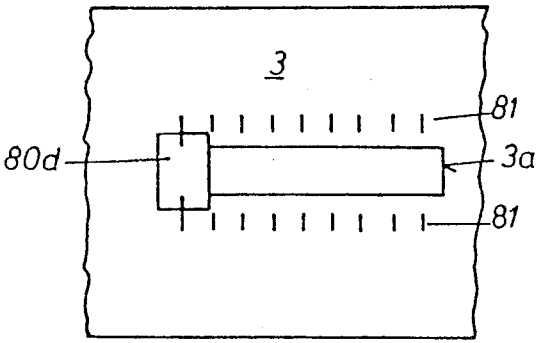
FIG. 13 is a fragmentary top view of the embodiment of FIG. 11.

The embodiment which is illustrated in FIGS. 11–13 differs from the two preceding ones in that the handle 80*d* is secured by means of a boltlike or pinlike part on the portion 80*a* of the slide member which carries the inclined surface. The boltlike part extends through the slot 3*a* in the upper belt 3 of the ski 1. On both sides of the slot 3*a*, there is a scale 81 on the upper side of the upper belt 3, which makes possible a reading of the adjusted stiffness of the ski. The slide member 80 is slidably supported by guide bars 82 inserted into the sections of the core of the ski which are on opposite sides of the beam 6.

Figure 14:
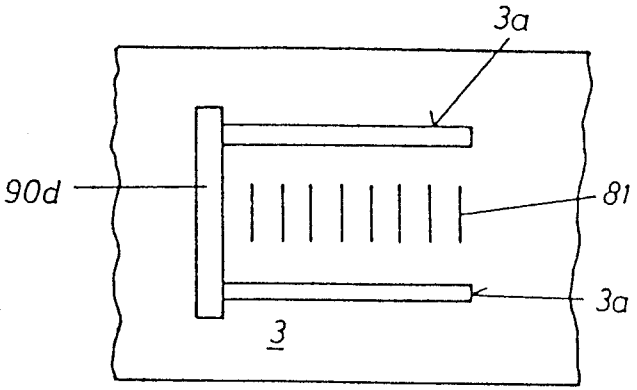
FIG. 14 a fragmentary top view of an alternative embodiment of the ski according to FIGS. 11–13.

A modification of the last embodiment is illustrated in FIG. 14. In this modification, the handle 90*d* is constructed as a crossbeam and is connected to the not illustrated slide member by two boltlike or pinlike parts which extend perpendicular to the upper side of the ski and extend through respective transversely spaced longitudinal slots 3*a* in the upper belt 3 of the ski.

Figure 16:
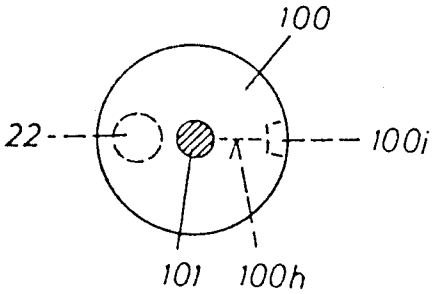
FIG. 16 is a top view of a slide member which is a component of the embodiment of FIG. 15 and is constructed as a rotary slide member.
Figure 15:
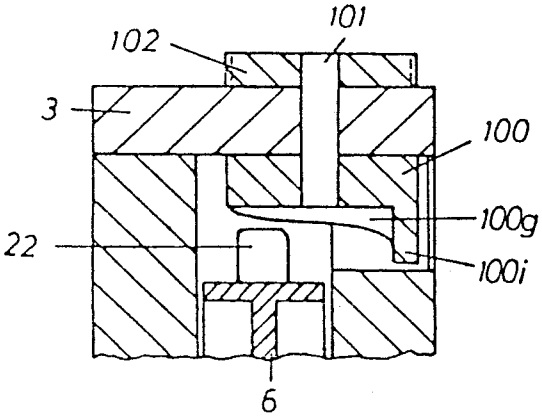
FIG. 15 is a fragmentary sectional side view of still another alternative embodiment.

One last embodiment is shown in FIGS. 15 and 16. In this embodiment, in place of a longitudinal slide member of the type provided in the preceding exemplary embodiments, a rotary slide member 100 is used which has as its underside a screw surface 100*g*. The rotary slide member 100 is secured on a shaft 101 which extends through the upper belt 3 and carries at its upper end a disk 102. The disk 102 is knurled on its periphery, is provided with a scale, and can be engaged by the fingers of the user. On the rotary slide member 100, in the region of a radial wall 100*h* which connects the start and the end of the screw surface 100, and extends parallel to the shaft 101, there is arranged a stop 100*i* which is designed for engaging the pin 22 on the beam 6.

In order to reliably prevent, in all embodiments an unintended movement or rotation of the slide member or adjusting disk, the slide member or adjusting disk can be held in a selected position by a locking element which is shown in FIGS. 17–20.

Figure 17:
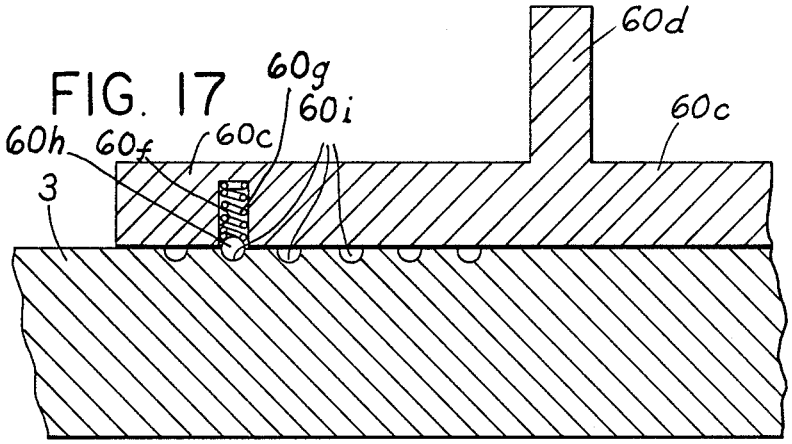
FIG. 17 is a sectional view similar to FIG. 8 showing an alternative embodimetn of the ski of FIG. 8.
Figure 18:
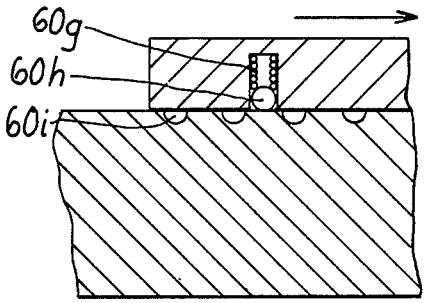
FIG. 18 is a sectional view similar to FIG. 17 of the embodiment of FIG. 17 in a different position of operation.
Figure 19:
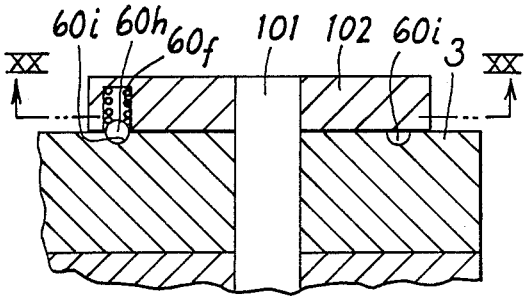
FIG. 19 is a sectional view similar to FIG. 15 showing an alternative embodiment of the ski of FIG. 15.
Figure 20:
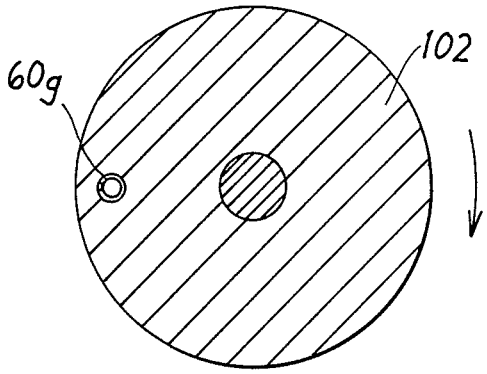
FIG. 20 is a sectional view taken along the line XX—XX in FIG. 19.

FIGS. 17 and 18 show the slide member 60 which is embodied in FIG. 8. in conjunction with a locking mechanism. The portion 60*c* has a bore 60*f* which contains a helical spring 60*g*. The spring 60*g* biases a ball 60*h* which can engage rests or detents 60*i* in the upper belt 3. When the slide member 60 is moved by hand, the ball 60*h* moves upwardly against the urging of the spring 60*g* and leaves the rest 60*i*, as shown in FIG. 18, and subsequently engages another rest 60*i* to define a different selected position of the slide member 60. FIGS. 19 and 20 show how to use the principle of a spring biased ball locking mechanism of the type just described in a ski of teh type shown in FIG. 15. The upper belt 3 has plural rests 60*i* which are placed along a circle under the disk 102 which contains a bore 60*f* with a helical spring 60*g* biasing a ball 60*h*.

Of course, the invention is by no means limited to the exemplary embodiments which are described above and illustrated in the drawings. Rather, various variations and modifications, including the rearrangement of parts, are possible without leaving the scope of the invention. For example, the rack which mates with the pinion could also be guided below the upper belt in guideways, so that the entire slide member is then arranged within the space 5*a*.

The embodiments of the invention in which an exclusive property or privilege is claimed are defined as follows:

1. In a cross-country ski having a flexible body runner with a core defined by a pair of laterally spaced sidewalls, an upper belt and a lower belt, the bending resistance of which can be changed with the help of at least one bending beam which extends longitudinally of said body runner and is arranged in the center of said body runner, the improvement comprising wherein said body runner has means defining a cavity between said upper belt and said lower belt of said body runner in a region beneath a location on said upper belt of said body runner whereat a ski shoe is to be mounted, said bending beam being loosely arranged inside of said cavity in said body runner symmetrically in relationship to a vertical longitudinal center plane of said body runner and being supported at its two ends on support surface means defined by longitudinal end walls of said cavity, said support surface means extending approximately parallel with respect to a running surface on a bottom surface of said body runner and wherein force applying means selectively operable at any position between a pair of limits are provided on said body runner for applying at least one of a gradually increasing and decreasing force to said bending beam on a side thereof remote from a side of each of said two ends supported on said support surface means, said force applying means being located in the region of said upper belt of said body runner.

2. The ski according to claim 1, wherein said bending beam has an I-profile and, in the region of its said two ends and also its center, includes reinforcing means.

3. The ski according to claim 1, wherein said force applying means is a slide member which has an inclined surface, and wherein a portion of said slide member which has said inclined surface thereon is disposed at least partly in a recess which extends between said bending beam and said upper belt of the body runner.

4. The ski binding according to claim 1, wherein said force is applied in a direction approximately perpendicular to said running surface.

5. The ski according to claim 1, wherein said force applying means includes locking means for locking said force applying means in any one of a plurality of selected positions intermediate said pair of limits.

6. The ski binding according to claim 1, wherein said force applying means is a screw which is arranged in a plate which is provided with a tapped hole and is secured to said upper belt on said body runner.

7. The ski according to claim 3, wherein said portion of said slide member which has said inclined surface thereon is rigidly connected by means of a crosspart guided in a longitudinal slot in said upper belt to a further portion which has a handle and is movable on said upper belt.

8. The ski according to claim 7, wherein said portion of said slide member which has said handle is guided in guide rails secured to said upper belt of said body runner.

9. The ski according to claim 8, wherein said portion of said slide member which is guided in said guide rails is a rack which extends in the direction of movement of said slide member, is guided between said guide rails, and is movable longitudinally of said body runner by means of a pinion, said pinion having a shaft which is supported rotatably on said body runner and carriers a rotary knob.

10. The ski according to claim 3, wherein said portion of said slide member which has said inclined surface is movable longitudinally of said body runner in guideways arranged beneath said upper belt.

11. The ski according to claim 10, wherein at least one bolt extending perpendicular to said upper belt of said body runner is secured on said portion of said slide member which has said inclined surface, which bolt carries a handle and is movable in a slot in said upper belt.

12. The ski according to claim 11, wherein a scale is arranged on at least one longitudinal side of said slot and is associated with said handle.

13. The ski according to claim 3, wherein said portion of said slide member which has said inclined surface is a rotary slide member having a shaft which is offset with respect to a pin on said bending beam and which has an underside which faces said pin and having a screw-like surface thereon.

14. The ski according to claim 13, wherein said portion of said slide member which has said inclined surface is connected by said shaft to a knurled disk having a scale which is associated with an index mark on said upper belt of said body runner, and wherein said portion carries a stop which, during rotation of said shaft, engages said pin of said bending beam and in this manner limit the angle of rotation of said rotary slide member.

15. The ski according to claim 3, wherein said slide member is held in a selected position by a locking means which is biased by a compression spring.

16. In a cross-country ski, the bending resistance of which can be changed with the helt of at least one bending beam which extends longitudinally of said ski and is arranged in the center region of said ski, the improvement comprising wherein said ski has means defining a cavity between an upper surface and a lower surface of said ski in a region beneath a location on said upper surface of said ski whereat a ski shoe is to be mounted, said bending beam being arranged loosely inside of said cavity in said ski symmetrically in relationship to a vertical longitudinal center plane of said ski and is supported at its two ends on support surface means defined by longitudinal end walls of said cavity, said support surface means extending approximately parallel to a running surface on a bottom surface of said ski, wherein control means is mounted on said ski and being responsive to both a lifting force and a downward force applied by the skier to a heel of a ski shoe during use in skiing for applying a force to said bending beam when at least one of said lifting force and said downward force exists and removing said force from said bending beam when at least the other of said lifting force and said downward force exists, and wherein said bending beam, on a side thereof remote from a side of each of said two ends supported on said support surface means, has a pressure-transmitting member to which pressure toward said bending beam can be applied by said control means operated by said ski shoe of the skier.

17. The ski according to claim 16, wherein said control means includes a sole plate which is supported pivotally on a transverse axle fixed to said upper surface of the ski.

18. The ski according to claim 16, wherein said control means includes at least one slide member supported for movement longitudinally of said ski, wherein said control means further includes at least one spring for continually urging said slide member in one direction, wherein said pressure-transmitting member is a bolt the longitudinal axis of which extends perpendicular to said bending beam and which is secured thereto, said bolt being movable up and down in a bore in said upper surface of said ski and being held, in an active position of said bending beam, by said slide member which can be moved against the force of said spring in a direction parallel to said upper surface of said ski, and wherein for moving said slide member there is provided above said slide member a pressure piece which can be moved by a pedal operated by the front portion of said ski shoe and which is wedge-shaped on its underside.

19. The ski according to claim 18, wherein said bolt carriers at its upper end a rib which is rectangular in cross section and which is received in a groove in said pressure piece, which groove is also rectangular in cross section.

20. The ski according to claim 19, wherein said rib and said groove extend in the direction of movement of said slide member.

21. In a cross-country ski, the bending resistance of which can be changed with the help of at least one bending beam which extends longitudinally of said ski and is arranged in the center region of said ski, the improvement comprising wherein said ski has means defining a cavity between an upper surface and a lower surface of said ski in a region beneath a location on said upper surface of said ski whereat a ski shoe is to be mounted, said bending beam being arranged loosely inside of said cavity in said ski symmetrically in relationship to a vertical longitudinal center plane of said ski and is supported at its two ends on support surface means defined by longitudinal end walls of said cavity, said support surface means extending approximately parallel to a running surface on a bottom surface of said ski, wherein control means is mounted on said ski and being responsive to both a lifting force and a downward force applied by the skier to a heel of a ski shoe during use in skiing for applying a force to said bending beam when at least one of said lifting force and said downward force exists and removing said force from said bending beam which at least the other of said lifting force and said downward force exists, and wherein said bending beam, on a side thereof remote from a side of each of said two ends supported on said support surface means, has a pressure-transmitting member to which pressure toward said bending beam can be applied by said control means operated by said ski shoe of the skier, wherein said pressure-transmitting member is a bolt which extends perpendicular to and is secured on said bending beam and which is guided for up and down movement in a bore extending between said upper surface of said ski and said cavity, and wherein said control means includes a slide member which is movable longitudinally of said ski in response to said forces applied to the heel of said ski shoe.

22. The ski according to claim 21, wherein said slide member is secured against an upward lifting off from said ski and is guided for movement longitudinally of the ski by guide rails on said upper surface.

23. The ski according to claim 22, wherein said slide member has a flat surface which extends at an acute angle with respect to said upper surface.

24. The ski according to claim 22, wherein said slide member has a convexly curved surface which extends at approximately an acute angle with respect to said upper surface.

25. The ski according to claim 22, wherein said control means includes a spring for urging said slide member toward one longitudinal position thereof.

26. The ski according to claim 22, wherein said slide member has an arc-shaped slot which extends longitudinally of said ski, said slot receiving a bolt therein which is supported at the ends of two arms of a swingably supported sole plate.

27. The ski according to claim 22, wherein said slide member is coupled by a linkage means to a sole plate which is pivotally supported on said ski adjacent a front end of said sole plate.

28. The ski according to claim 27, wherein said slide member has on a rearwardly facing side thereof which faces said sole plate a concavely curved control surface, with which is associated a front end of said sole plate which at its center is pivotally supported.

29. The ski according to claim 28, wherein said front end of said sole plate which faces said control surface is provided with at least one roller.

* * * * *

UNITED STATES PATENT AND TRADEMARK OFFICE

CERTIFICATE OF CORRECTION

PATENT NO. : 4 754 989

DATED : July 5, 1988

INVENTOR(S) : Klaus HOELZL

It is certified that error appears in the above-identified patent and that said Letters Patent is hereby corrected as shown below:

Title page:

In the Foreign Application Priority Data section on the face of the patent change "424/84" to ---425/84---.

Signed and Sealed this

Second Day of May, 1989

*Attest:*

DONALD J. QUIGG

*Attesting Officer*

*Commissioner of Patents and Trademarks*